US009399160B2

(12) United States Patent
Stover

(10) Patent No.: US 9,399,160 B2
(45) Date of Patent: Jul. 26, 2016

(54) THROWING SLEEVE WITH VISUAL BIO-FEEDBACK

(71) Applicant: Coaches Studio, LLC, Woodstock, GA (US)

(72) Inventor: Herbert A. Stover, Canton, GA (US)

(73) Assignee: Coaches Studio, LLC, Woodstock, GA (US)

( * ) Notice: Subject to any disclaimer, the term of this patent is extended or adjusted under 35 U.S.C. 154(b) by 0 days.

(21) Appl. No.: 14/727,599

(22) Filed: Jun. 1, 2015

(65) Prior Publication Data

US 2015/0343287 A1 Dec. 3, 2015

Related U.S. Application Data

(60) Provisional application No. 62/006,645, filed on Jun. 2, 2014.

(51) Int. Cl.

| | |
|---|---|
| ***A63B 69/00*** | (2006.01) |
| ***A63B 24/00*** | (2006.01) |
| ***A63B 71/06*** | (2006.01) |
| ***A63B 23/12*** | (2006.01) |
| *A63B 69/36* | (2006.01) |

(52) U.S. Cl.

CPC ..... *A63B 69/0002* (2013.01); *A63B 21/4021* (2015.10); *A63B 23/12* (2013.01); *A63B 24/0003* (2013.01); *A63B 71/0619* (2013.01); *A63B 69/0059* (2013.01); *A63B 69/3608* (2013.01); *A63B 2069/0006* (2013.01); *A63B 2069/0008* (2013.01); *A63B 2071/0625* (2013.01); *A63B 2071/0647* (2013.01); *A63B 2208/0204* (2013.01); *A63B 2220/803* (2013.01); *A63B 2225/50* (2013.01)

(58) Field of Classification Search

CPC .. A63B 69/086; A63B 15/00; A63B 23/1245; A63B 23/1263; A63B 24/0003; A63B 69/00; A63B 69/0002; A63B 69/0046; A63B 65/00

USPC ..... 473/422, 450, 458, 464, 60, 424; 128/879; 2/16, 161.1

See application file for complete search history.

(56) References Cited

U.S. PATENT DOCUMENTS

| | | | | | |
|---|---|---|---|---|---|
| 973,330 | A * | 10/1910 | Wood | A61F 5/50 | 128/879 |
| 1,537,811 | A * | 5/1925 | Epling | A61F 5/50 | 128/879 |
| 2,074,390 | A * | 3/1937 | Green | A41D 19/015 | 2/16 |
| 2,682,290 | A * | 6/1954 | Ditlea | A45C 3/045 | 206/8 |

(Continued)

FOREIGN PATENT DOCUMENTS

| | | | | |
|---|---|---|---|---|
| JP | 411244438 | A * | 9/1999 | A63B 69/0002 |

*Primary Examiner* — Mitra Aryanpour
(74) *Attorney, Agent, or Firm* — Eliezer IP

(57) ABSTRACT

A throwing sleeve with visual biofeedback may be provided. Embodiments of the present disclosure may be comprised of a sleeve. The sleeve may be comprised of a plurality of segments forming a single, internal passageway with at least one opening. A first opening may be configured to receive an object (e.g., baseball or softball) into the internal passageway of the sleeve. A second opening may be configured to receive a user's hand. Embodiments may further comprise a means for securing the user's hand within the internal passageway of the sleeve. Still further, embodiments may comprise at least one stripe running parallel to an edge of each of the plurality of segments.

19 Claims, 8 Drawing Sheets

(56) References Cited

U.S. PATENT DOCUMENTS 2,728,914 A * 1/1956 Mercur ..... A61F 13/104 2/16
4,213,205 A * 7/1980 Smith ..... A41D 19/0017 2/161.1
4,220,333 A * 9/1980 Mercer ..... A63B 69/0046 473/60
4,477,075 A * 10/1984 Outman ..... A63B 69/0086 473/458
5,711,032 A * 1/1998 Carpenter ..... A41F 1/06 2/158
5,733,201 A 3/1998 Caldwell et al.
5,878,435 A * 3/1999 Kast ..... A41D 13/08 2/16
7,264,554 B2 9/2007 Bentley
7,955,197 B2 * 6/2011 Roudybush ..... A63B 15/00 473/424
8,641,561 B2 * 2/2014 Suppan ..... A63B 69/0002 473/458
2007/0105663 A1 * 5/2007 Farnsworth ..... A63B 15/00 473/422
2011/0172036 A1 * 7/2011 Suppan ..... A63B 69/0002 473/458
2012/0052990 A1 * 3/2012 Arnold ..... A63B 69/0002 473/458
2013/0244815 A1 * 9/2013 Kuo ..... A63B 69/0002 473/458
2015/0343287 A1 * 12/2015 Stover ..... A63B 69/0002 473/458

* cited by examiner

THROWING SLEEVE WITH VISUAL BIO-FEEDBACK

RELATED APPLICATION

Under provisions of 35 U.S.C. §119(e), the Applicant claims the benefit of U.S. provisional application No. 62/006,645, filed 2 Jun. 2014, which is incorporated herein by reference.

It is intended that each of the referenced applications may be applicable to the concepts and embodiments disclosed herein, even if such concepts and embodiments are disclosed in the referenced applications with different limitations and configurations and described using different examples and terminology.

FIELD OF DISCLOSURE

The present disclosure generally relates to athletic training methods and devices.

BACKGROUND

An athlete, such as, for example a baseball player, may frequently practice throwing a baseball to improve, for example, his pitch. After the ball is thrown, conventional training methods require the ball to be retrieved back to player by, for example, a catcher. A catcher, however, may not always be available, and it might not always be convenient to for the player to throw to someone else. U.S. Pat. No. 4,477,075 (hereinafter referred to as the '075 patent) discloses a device for allowing a player to practice throwing a baseball without need for a backstop or catcher. However, the device in the '075 patent fails to provide the thrower with feedback as to the proper wrist and forearm position, as well as other useful information about the throw. With arm injuries to the elbow and shoulder at an all-time high, the proper arm position when executing a throw is critical to help prevent arm and shoulder injuries. Providing visual bio-feedback may assist with identifying and positioning of the arm to help correct problem areas.

BRIEF OVERVIEW

A throwing sleeve with visual biofeedback may be provided. This brief overview is provided to introduce a selection of concepts in a simplified form that are further described below in the Detailed Description. This brief overview is not intended to identify key features or essential features of the claimed subject matter. Nor is this brief overview intended to be used to limit the claimed subject matter's scope.

A throwing sleeve with visual bio-feedback (hereinafter referred to as the 'device') may be used as a teaching and development tool for instructing on the proper wrist and forearm positions for throwing a ball, such as, but not limited to, for example, a baseball or softball. The device may fit over an individual's throwing arm. The device may eliminate the need for a throwing partner or a large area to throw across. The device may contain marking stripes that indicate the user's arm position throughout the throwing motion. The markings on the device may provide visual feedback to the user or a third party reviewing the user's throw. For example, as the user throws a baseball using the device, a visual observation of the markings on the device during the throw may indicate whether or not the user is throwing using the proper motions. Moreover, the visual observation of the markings during the throw may further indicate where the user's motion is incorrect. This may allow the user to correct his motion in an isolated manner. The markings may also enable the user to align the arm throwing motion with the rest of the body in the proper kinetic sequence.

Accordingly, the device may help to improve the user's movement, control and velocity of the ball. In this way, the device may prevent injuries by teaching the user to use proper motion. Furthermore, the device enables the user to practice while traveling or in constricted areas with limited space without the need of a throwing partner, thereby reducing the need for expensive training spaces.

In some embodiments, the device may incorporate sensors to further provide feedback to the user. For example, sensors may measure the speed and angular velocity of the throw as well as the angle of the release. In yet further embodiments, the ball with which the device is used may be integrated with sensors that interact with the sensors integrated in the device. In this way, the ball may communicate, by way of sensor detection or active communication, various parameters to the device sensors which, in turn, may read and process the data from the ball.

A throwing sleeve with visual biofeedback may be provided. Embodiments of the present disclosure may be comprised of a sleeve. The sleeve may be comprised of a plurality of segments forming a single, internal passageway with at least one opening. A first opening may be configured to receive an object (e.g., baseball or softball) into the internal passageway of the sleeve. A second opening may be configured to receive a user's hand. Embodiments may further comprise a means for securing the user's hand within the internal passageway of the sleeve. Still further, embodiments may comprise one ore more stripes running parallel to an edge of each of the plurality of segments.

In some embodiments, the one or more stripes may be comprised of a material used to delineate the stripe from a material of the sleeve.

In further embodiments, the stripes may be a different color for each edge of the plurality of segments.

In still further embodiments, the means for securing the user's hand comprises a wristband.

In some embodiments, the sleeve may be comprised of a mesh substance.

Further, some embodiments may be comprised of a means for bracing an internal portion of the sleeve.

Further embodiments may be comprised of a material to further reinforce a closed end of the internal passageway.

In still further embodiments, the material may be configured to provide an audible sound upon receiving an impact from an object thrown within the internal passageway.

Some embodiments consistent with the present disclosure may comprise a system comprised of a sleeve comprising a plurality of segments forming a single, internal passageway with a single opening, the opening configured to receive an object into the internal passageway of the sleeve, a means for securing a user's hand within the internal passageway of the sleeve, and at least one stripe running parallel to an edge of each of the plurality of segments. The system may further comprise at least one sensor and a computing device comprised of a memory storage and a processing unit coupled with the memory storage, wherein the processing unit is operative to receiving a signal from the at least one sensor.

In some embodiments of the system, the at least one sensor may be attached to the sleeve.

In further embodiments, the at least one sensor may be wirelessly connected to the computing device.

In further embodiments of the system, the processing unit may be further operative to calculate data corresponding to the signal received from the at least one sensor.

In further embodiments, the processing unit may be further configured to provide metrics associated with an object within the internal passageway of the sleeve.

In some embodiments, the processing unit may be further operative to creating a visual rendering of a user's motions using the calculated data.

In some embodiments, the processing unit may be further operative to receiving at least one condition corresponding to a potential signal to be received and providing an output when the signal meets the at least one condition.

Some embodiments may be further comprised of at least one button, and receiving the at least one condition comprises receiving a condition after receiving selection from the button and receiving a signal from the sensor.

In some embodiments, the at least one condition may be comprised of a speed, a wrist angle, an axis of rotation, and/or a release point.

Both the foregoing brief overview and the following detailed description provide examples and are explanatory only. Accordingly, the foregoing brief overview and the following detailed description should not be considered to be restrictive. Further, features or variations may be provided in addition to those set forth herein. For example, embodiments may be directed to various feature combinations and sub-combinations described in the detailed description.

BRIEF DESCRIPTION OF THE DRAWINGS

The accompanying drawings, which are incorporated in and constitute a part of this disclosure, illustrate various embodiments of the present disclosure. The drawings contain representations of various trademarks and copyrights owned by the Applicants. In addition, the drawings may contain other marks owned by third parties and are being used for illustrative purposes only. All rights to various trademarks and copyrights represented herein, except those belonging to their respective owners, are vested in and the property of the Applicants. The Applicants retain and reserve all rights in their trademarks and copyrights included herein, and grant permission to reproduce the material only in connection with reproduction of the granted patent and for no other purpose.

Furthermore, the drawings may contain text or captions that may explain certain embodiments of the present disclosure. This text is included for illustrative, non-limiting, explanatory purposes of certain embodiments detailed in the present disclosure. In the drawings.

DETAILED DESCRIPTION

Figure 1:
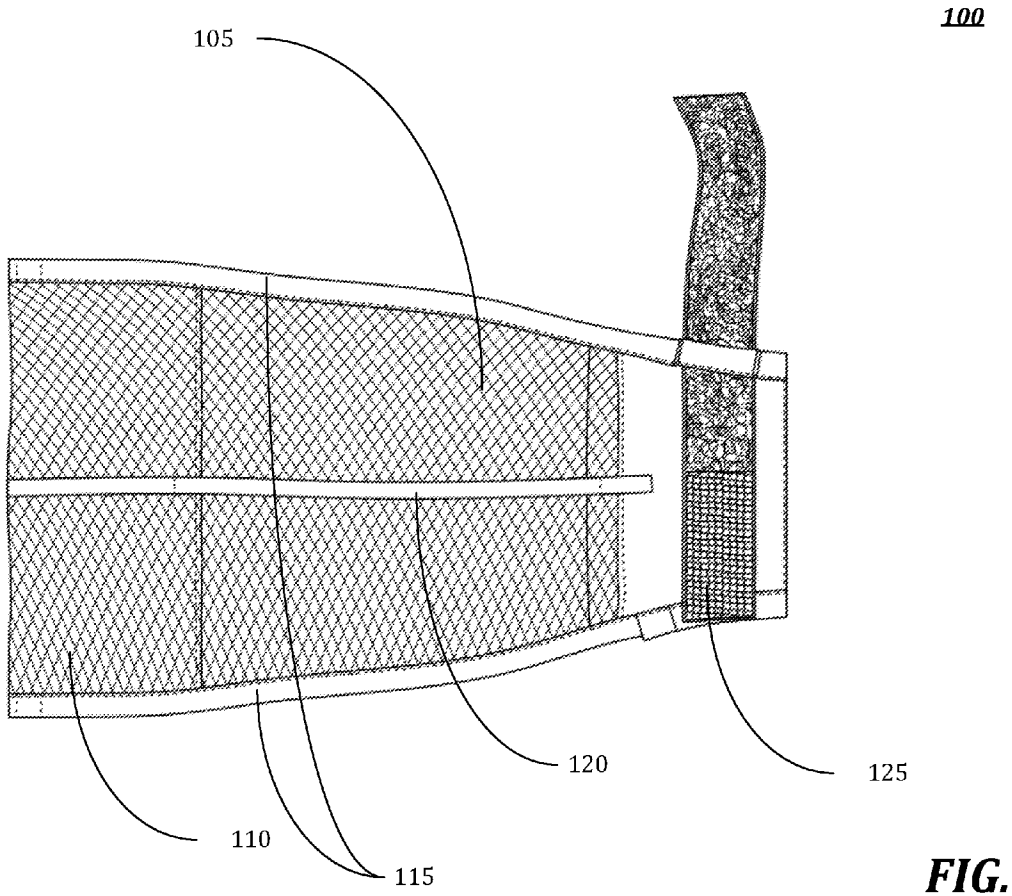
FIG. 1 illustrates a throwing sleeve.

As a preliminary matter, it will readily be understood by one having ordinary skill in the relevant art that the present disclosure has broad utility and application. As should be understood, any embodiment may incorporate only one or a plurality of the above-disclosed aspects of the disclosure and may further incorporate only one or a plurality of the above-disclosed features. Furthermore, any embodiment discussed and identified as being "preferred" is considered to be part of a best mode contemplated for carrying out the embodiments of the present disclosure. Other embodiments also may be discussed for additional illustrative purposes in providing a full and enabling disclosure. Moreover, many embodiments, such as adaptations, variations, modifications, and equivalent arrangements, will be implicitly disclosed by the embodiments described herein and fall within the scope of the present disclosure.

Accordingly, while embodiments are described herein in detail in relation to one or more embodiments, it is to be understood that this disclosure is illustrative and exemplary of the present disclosure, and are made merely for the purposes of providing a full and enabling disclosure. The detailed disclosure herein of one or more embodiments is not intended, nor is to be construed, to limit the scope of patent protection afforded in any claim of a patent issuing here from, which scope is to be defined by the claims and the equivalents thereof. It is not intended that the scope of patent protection be defined by reading into any claim a limitation found herein that does not explicitly appear in the claim itself.

Thus, for example, any sequence(s) and/or temporal order of steps of various processes or methods that are described herein are illustrative and not restrictive. Accordingly, it should be understood that, although steps of various processes or methods may be shown and described as being in a sequence or temporal order, the steps of any such processes or methods are not limited to being carried out in any particular sequence or order, absent an indication otherwise. Indeed, the steps in such processes or methods generally may be carried out in various different sequences and orders while still falling within the scope of the present invention. Accordingly, it is intended that the scope of patent protection is to be defined by the issued claim(s) rather than the description set forth herein.

Additionally, it is important to note that each term used herein refers to that which an ordinary artisan would understand such term to mean based on the contextual use of such term herein. To the extent that the meaning of a term used herein—as understood by the ordinary artisan based on the contextual use of such term—differs in any way from any particular dictionary definition of such term, it is intended that the meaning of the term as understood by the ordinary artisan should prevail.

Regarding applicability of 35 U.S.C. §112, ¶6, no claim element is intended to be read in accordance with this statutory provision unless the explicit phrase "means for" or "step for" is actually used in such claim element, whereupon this statutory provision is intended to apply in the interpretation of such claim element.

Furthermore, it is important to note that, as used herein, "a" and "an" each generally denotes "at least one," but does not exclude a plurality unless the contextual use dictates otherwise. When used herein to join a list of items, "or" denotes "at least one of the items," but does not exclude a plurality of items of the list. Finally, when used herein to join a list of items, "and" denotes "all of the items of the list."

The following detailed description refers to the accompanying drawings. Wherever possible, the same reference numbers are used in the drawings and the following description to refer to the same or similar elements. While many embodiments of the disclosure may be described, modifications, adaptations, and other implementations are possible. For example, substitutions, additions, or modifications may be made to the elements illustrated in the drawings, and the methods described herein may be modified by substituting, reordering, or adding stages to the disclosed methods. Accordingly, the following detailed description does not limit the disclosure. Instead, the proper scope of the disclosure is defined by the appended claims. The present disclosure contains headers. It should be understood that these headers are used as references and are not to be construed as limiting upon the subjected matter disclosed under the header.

The present disclosure includes many aspects and features. Moreover, while many aspects and features relate to, and are described in, the context of throwing a ball, embodiments of the present disclosure are not limited to use only in this context. For example, embodiments of the present disclosure may be used to capture, measure and provide visual, audible and/or electronic feedback or measurements from a wearable self-contained device attached to a user's hand, arm, or other body part that allows for any ball, object, or instrument to be thrown or propelled by any method.

I. Overview

Consistent with embodiments of the present disclosure, a throwing sleeve (i.e. the device) may be provided. This overview is provided to introduce a selection of concepts in a simplified form that is further described below. This overview is not intended to identify key features or essential features of the claimed subject matter. Nor is this overview intended to be used to limit the claimed subject matter's scope. The device may comprise marking strips that may provide visual biofeedback as the sleeve is used. The device may be used by individuals to improve their throwing form for sports including, but not limited to, for example, baseball or softball.

Embodiments of the device may be used as a teaching and development tool for proper wrist and forearm position as well as proper body position. Furthermore, the device may be used in any practice environment (indoors and outdoors) without impeding the user from practicing with full motion and maximum velocities. Thus, the construction of the device may allow for full body motion, while having segments defining arm and wrist angles for throwing.

Marking strips included on the device may provide visual feedback on the motion and location of the arm angles during a user throws a ball using the device. In various embodiments of the device, these marking strips may be viewable to both the user and other observing third party, such as, for example, an instructor.

The instructor may be performing a live observation or reviewing of a video recording of a user throwing a ball using the device. Without the markings properly placed on the device, the motions may be too fast to be observed. As will be described in greater detailed below, the feedback may be used to develop proper technique and eliminate faulty movements. Throughout the present disclosure, the terms "marking strips" and "markings" may be used interchangeably.

Embodiments of the present disclosure may be further comprised of electronic sensors. Such sensors may be incorporated to measure performance indicators such as, for example, but not limited to, speed, rotation, and spin rate. The sensor readings may be transmitted via wires or wirelessly. The readings may further be processed to be used in studies, instruction, comparison, gaming, or other uses. The readings may provide data points, which may be used to create an electronic rendering of the user's actions.

While the present disclosure describes application of the device with reference throwing a ball, it should be understood that embodiments may be used in any other similar action where an object is thrown by a user.

Both the foregoing overview and the following detailed description provide examples and are explanatory only. Accordingly, the foregoing overview and the following detailed description should not be considered to be restrictive. Further, features or variations may be provided in addition to those set forth herein. For example, embodiments may be directed to various feature combinations and sub-combinations described in the detailed description.

II. Device Design

Figure 2:
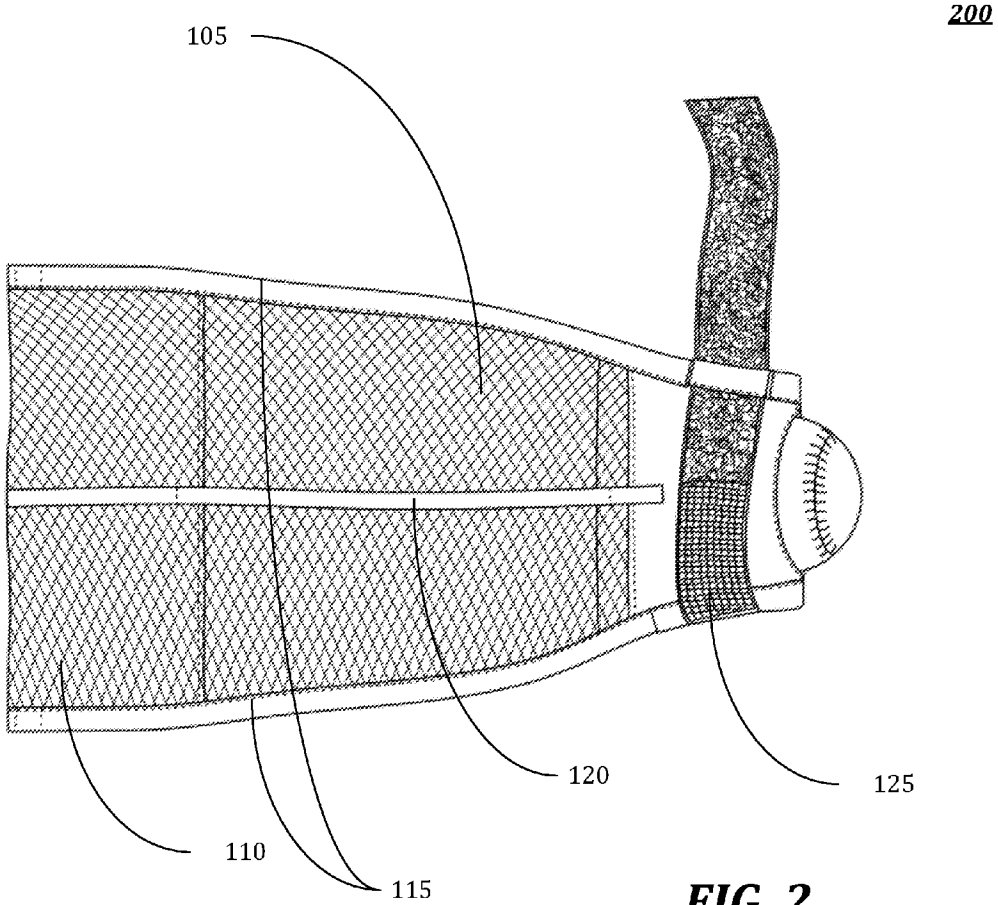
FIG. 2 illustrates a throwing sleeve with a ball.

FIG. 1 illustrates one possible embodiment of a throwing sleeve. FIG. 2 illustrates one possible embodiment of a throwing sleeve with a ball. Embodiments of this invention may be comprised of a transparent material 105 such as, for example, but not limited to, polyester or nylon. In various embodiments, the material may be configured in a mesh arrangement. This material may be able to withstand the impact of, for example, a baseball propagating at 100 miles per hour within the material. The material may range from, for example, but not be limited to, 36 to 48 inches in length and 10 to 14 inches in width to form a 'sleeve' configuration. The sleeve may further come in various shapes and sizes to enable various applications. The sleeve may be braced to prevent interference between the sleeve and the ball. For example, a rigid screen may be incorporated to hold the sleeve away from the ball. Embodiments may further comprise an end material 110 for receiving the impact of a ball. The end material may be comprised of a piece of light-weight material, such as, but not limited to, canvas to reinforce the impact zone's strength and resilience. The end material 110 may be configured to provide audible feedback as the ball impacts the end material 110. The end material 110 may further be configured with sensors to capture readings, such as, for example, but not limited to, impact and rotational forces.

The material may be further configured with markings 115. As mentioned above, the marking may be placed in particular positions of the device. These positions may be based on and derived from recent biomechanical discoveries for arm safety and incorporate studies of elite pitchers and their performance.

To place the markings, the material may be folded in half lengthwise. Two pieces of light-weight canvas of different colors may attach the sides of the sleeve. Embodiments of the invention may incorporate a third piece of colored canvas 120. This colored piece may be, for example, but not limited to, ½ inch wide and the same length as the sleeve, and may run along the middle of the top side of the sleeve. The colored pieces may comprise the aforementioned marking stripes used to provide the visual feedback for the wrist and forearm angle locations to the observer.

The side receiving the impact may be sewn shut or closed off using any other method for binding fabric. Embodiments of this invention may further incorporate a finger loop, attached to the inside of the sleeve under the middle marker. This finger loop may be used to line up the center marking strip with the middle finger of the user's throwing hand.

Embodiments of this invention may be comprised of a material used to make an adjustable cuff 125 for the user. The cuff 125 may be made of, but not limited to, a two-inch stretchable hook and loop material like Velcro®. The cuff may also be made of, but not limited to, a leather strap with a buckle for added security during high-velocity throws. The wrist band may incorporate marking stripes that align with the netting marking stripes. Such marking stripes may enable a user to use only the wrist band (without the sleeve) and still receive bio-feedback.

III. Device Operation

Figure 3:
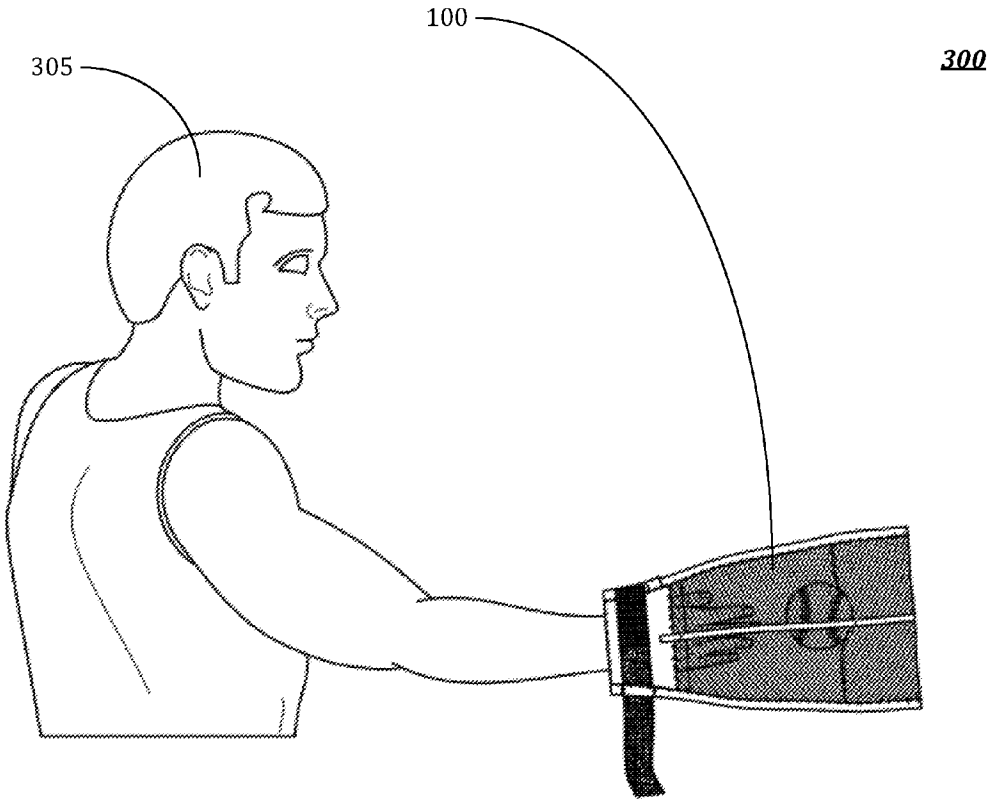
FIG. 3 illustrates a throwing sleeve being worn by a user.
Figure 4:
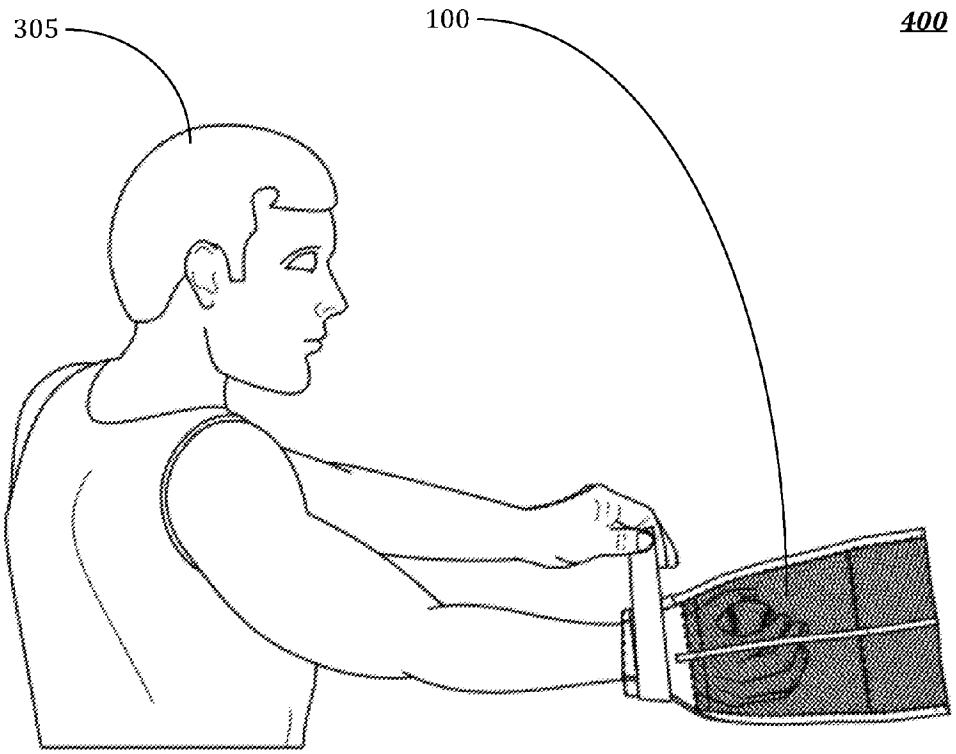
FIG. 4 illustrates a throwing sleeve being strapped to a user's wrist.
Figure 5:
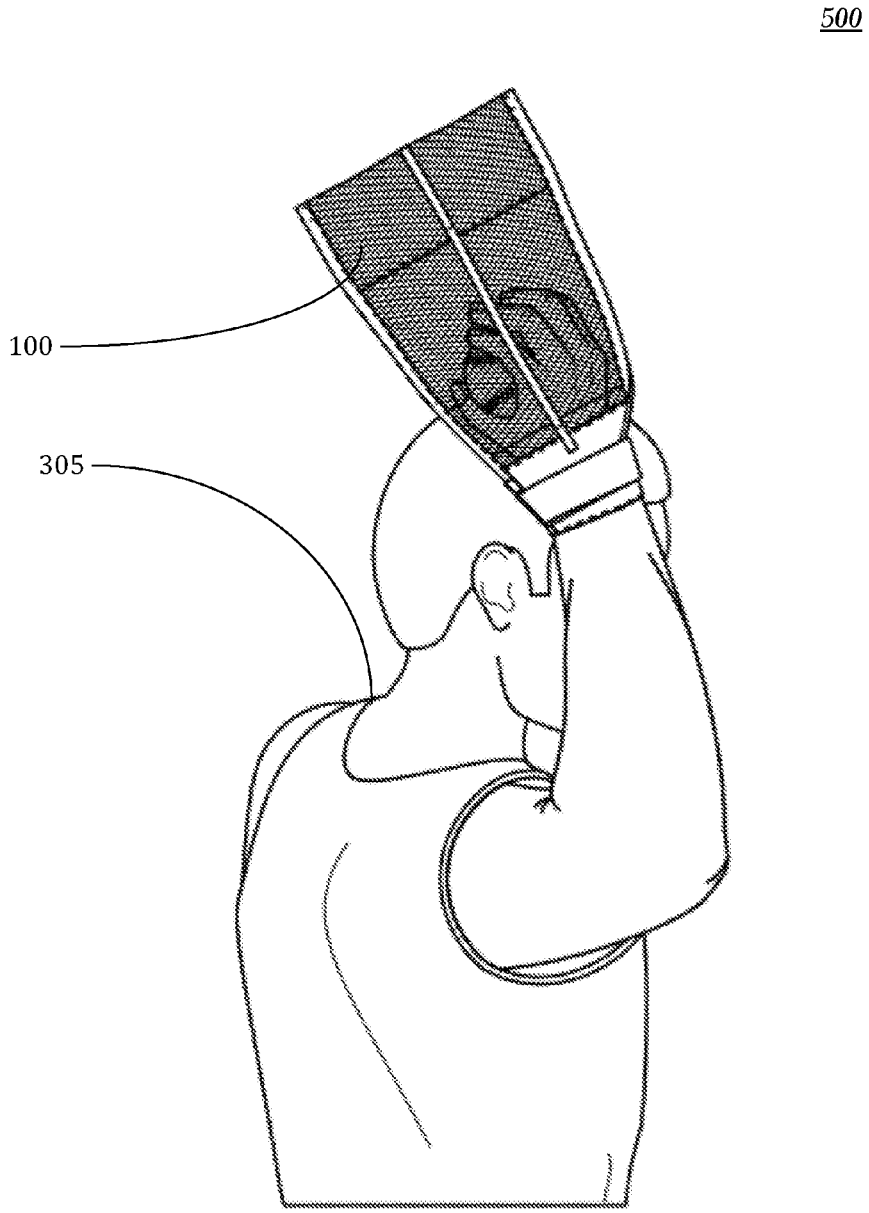
FIG. 5 illustrates a throwing sleeve being used.

A user may use embodiments of this invention by first placing a ball in the sleeve. Then, the user may place his or her hand into the sleeve, aligning the marking strips on the left, middle and right sides of his hand at ninety-degree angles. FIGS. 3-5 illustrate embodiments 300-500 of the device being worn and used by a user.

The user may place his middle finger through the finger loop. The user may then tighten the cuff onto the wrist in the mesh. In some embodiments, the sleeve may be measured from the end of the middle finger, other hand or body parts, to the end of the sleeve to provide a consistent measurement for each use.

Then, the user may perform his throw. The marker stripes may be recorded by video or visual observations to note the locations of the markers through the entire motion. The user may then observe or be made aware of any mistakes in his throw. The user may then take corrective action and repeat the process.

The stripes may provide immediate feedback of the pronation factor and position as the arm has completes the throwing motion. Embodiments of the device comprising the lightweight mesh may minimize the interference with the throw. Further, the mesh allows for observation of the fingers on the ball and their release action.

IV. Electronic Component Architecture

Figure 6:
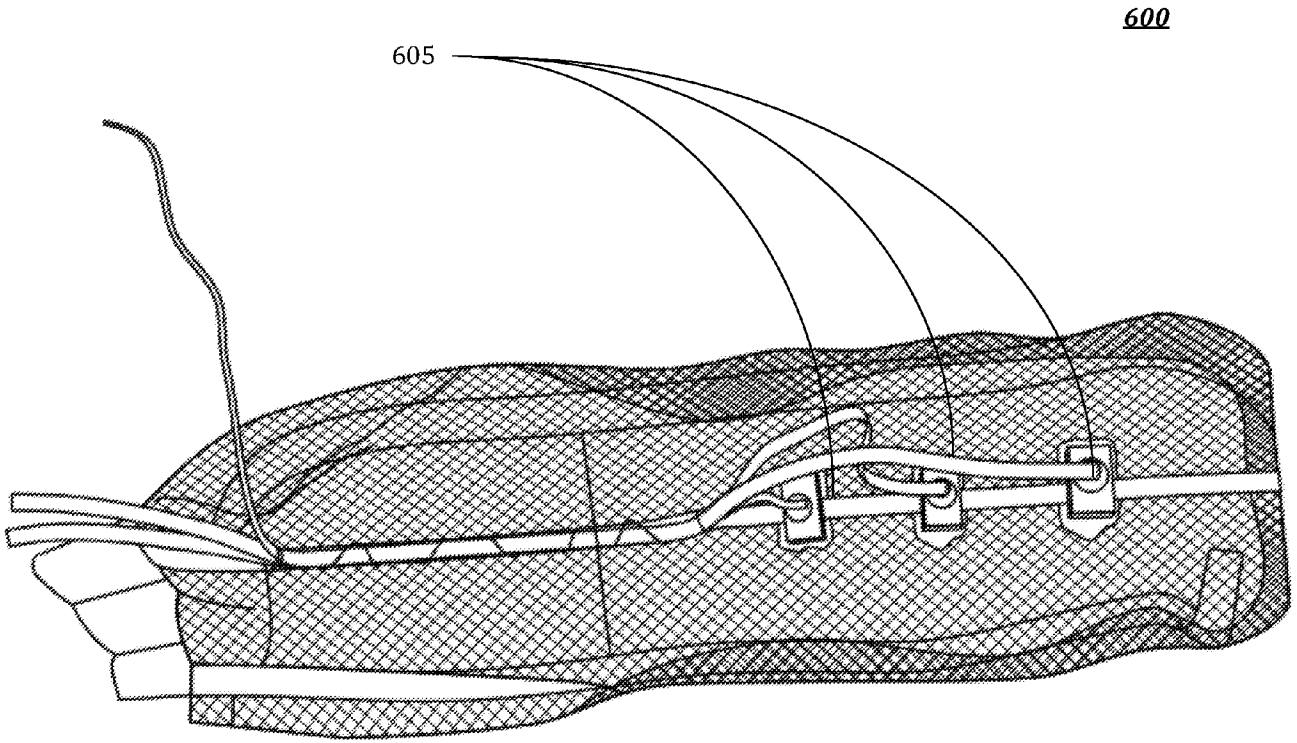
FIG. 6 illustrates an embodiment of a throwing sleeve with sensing devices.

Embodiments of this device may further incorporate sensors to identify various aspects of, for example, a user's throw. FIG. 6 illustrates an embodiment 600 comprising sensors 605. These aspects may include, arm position, hand position, ball velocity, rotational speed, and direction. The sensors 605 may comprise, but not be limited to, devices capable of measuring acceleration, velocities, projectiles, axis of rotations, rotational speeds, direction of propagation (e.g., relative to, for example, a horizontal or vertical plane). Sensors may further be incorporated to provide measurements for gaming applications, such as, for example, virtual pitching in a baseball game.

Figure 7:
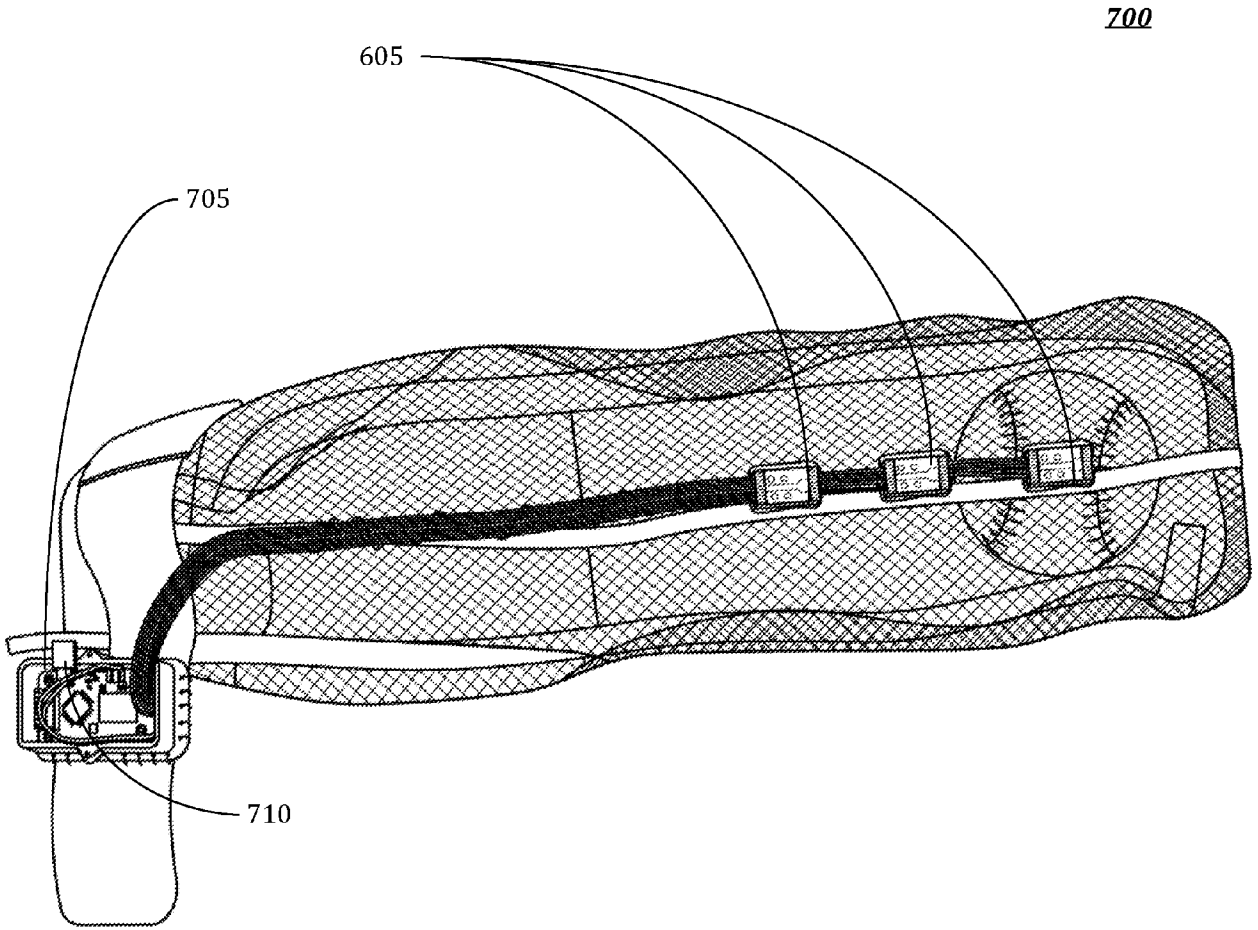
FIG. 7 illustrates another embodiment of throwing sleeve with integrated sensing devices.

The sensors 605 used to detect these characteristics may be placed throughout the device (e.g. on the wristband and along the sleeve). FIG. 7 illustrates an embodiment 700 comprising sensors 605 and a component housing 705. The component housing 705 may comprises, for example, but not be limited to, a processing unit and a memory storage along with communication modules. One example on the components housed in housing 705 may include computing device 800.

In some embodiments, the sensors may be placed on, for examples, the user's fingers (e.g., embedded in the finger loop), hand, and arm or body part. Still consistent with embodiments of the present invention, the sensors may be in communication without sensors placed throughout the user's body.

The sensors may be configured with data transmission capability. In some embodiments, the sensors may comprise on-board communications components, while in other-embodiments, the communications module may be located in remote proximity to the sensors. The communications module may receive signals from the sensors and communicate the signals to a computing device. Each signal may have a unique ID to identify the sensor and data being transmitted by the sensor. The communication between the sensors, the communications module, and the computing device, may be performed using, but not limited to, for example, wired or RF transmission (e.g., Wi-Fi or Bluetooth). The signals may be embedded with metadata, such as, for example, timing, such that the platform may capture at what point each sensor's data was received, thereby enabling reconstruction of the user's actions.

The signal may be transmitted to a computing device which may comprise, for example, a mobile device (e.g., laptop, tablet or smartphone), desktop device, and/or a server. In some embodiments, some or all of the computing device may be incorporated into the device. The computing device may comprise a platform for receiving and processing the received signals. The platform may be embodied as, for example, but not be limited to, a website, a web application, a desktop application, and a mobile application compatible with a computing device. The computing device may comprise, but not be limited to, a desktop computer, laptop, a tablet, or mobile telecommunications device. Moreover, the platform may be hosted on a centralized server, such as, for example, a cloud computing service.

The platform may receive real time sensor readings, process the readings, and display the processed results in a user-friendly, informative manner. In order to accurately process the signal readings, various embodiments may enable a user to input various parameters including, but not limited to, for example, height to the user, distance traveled by the projective, fixed size but variable positioning of target with respect to width or heights. In this way, a user may build a profile and, in turn, the platform may be used to track and record historical data for a plurality of users. Furthermore, in some embodiments, the platform may be able to simulate the user's throw based on the sensor data readings. The simulation may include a calculated path of the projective within the device, as well as the user's motions in launching the projectile (i.e., the ball). The simulation may further include a computer generation of the user's form. For example, a stick figure or 3-dimensional computer-generation may be created and displayed to the user. In this way, embodiments of the present disclosure may be used to provide virtual game experience.

The platform may receive parameters for reference points corresponding to metrics (i.e. 'conditions'), such as, for example, a speed, wrist angle, axis of rotation, and release point, and each reference point may correspond to a particular type of pitch. These reference points may be, for example, manually input (e.g., when the user presses a button 710 on the wristband), or may be recorded from previous use. When such reference points are reached or surpassed, the platform may inform the user, with, for example, an alarm. In this way, the user may be informed when he or she reaches a new achievement, such as, for example, a new fastest or best throw. Alternatively, the user may be informed when he or she uses a throwing form outside the tolerance of the reference points. The platform may further display user metrics as well as reference points.

Embodiments of the present disclosure may comprise a system having a memory storage and a processing unit. The processing unit coupled to the memory storage, wherein the processing unit is configured to perform the stages involved in data acquisition and processing.

Figure 8:
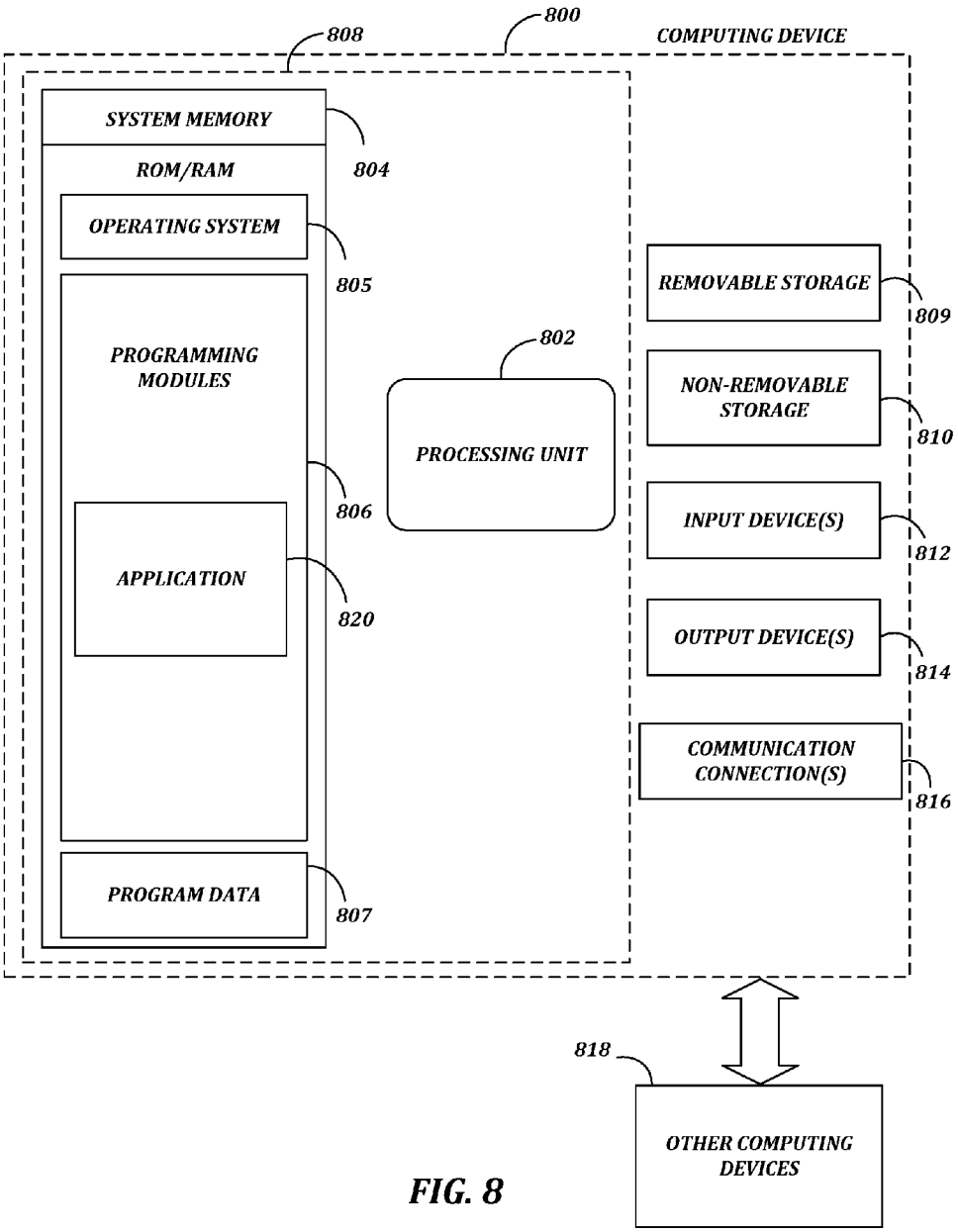
FIG. 8 is a block diagram of a system including a computing device for performing the method for data acquisition and transmission.

FIG. 8 is a block diagram of a system including computing device 800. Consistent with an embodiment of the disclosure, the aforementioned memory storage and processing unit may be implemented in a computing device, such as computing device 800 of FIG. 8. Any suitable combination of hardware, software, or firmware may be used to implement the memory storage and processing unit. For example, the memory storage and processing unit may be implemented with computing device 800 or any of other computing devices 818, in combination with computing device 800. The aforementioned system, device, and processors are examples and other systems, devices, and processors may comprise the aforementioned memory storage and processing unit, consistent with embodiments of the disclosure.

With reference to FIG. 8, a system consistent with an embodiment of the disclosure may include a computing device, such as computing device 800. In a basic configuration, computing device 800 may include at least one processing unit 802 and a system memory 804. Depending on the configuration and type of computing device, system memory 804 may comprise, but is not limited to, volatile (e.g. random access memory (RAM)), non-volatile (e.g. read-only memory (ROM)), flash memory, or any combination. System memory 804 may include operating system 805, one or more programming modules 806, and may include a program data 807. Operating system 805, for example, may be suitable for controlling computing device 800's operation. In one embodiment, programming modules 806 may include, for example throw speed calculation application 820. Furthermore, embodiments of the disclosure may be practiced in conjunction with a graphics library, other operating systems, or any other application program and is not limited to any particular application or system. This basic configuration is illustrated in FIG. 8 by those components within a dashed line 808.

Computing device 800 may have additional features or functionality. For example, computing device 800 may also include additional data storage devices (removable and/or non-removable) such as, for example, magnetic disks, optical disks, or tape. Such additional storage is illustrated in FIG. 8 by a removable storage 809 and a non-removable storage 810. Computer storage media may include volatile and nonvolatile, removable and non-removable media implemented in any method or technology for storage of information, such as computer readable instructions, data structures, program modules, or other data. System memory 804, removable storage 809, and non-removable storage 810 are all computer storage media examples (i.e., memory storage.) Computer storage media may include, but is not limited to, RAM, ROM, electrically erasable read-only memory (EEPROM), flash memory or other memory technology, CD-ROM, digital versatile disks (DVD) or other optical storage, magnetic cassettes, magnetic tape, magnetic disk storage or other magnetic storage devices, or any other medium which can be used to store information and which can be accessed by computing device 800. Any such computer storage media may be part of device 800. Computing device 800 may also have input device(s) 812 such as a keyboard, a mouse, a pen, a sound input device, a touch input device, etc. Output device(s) 814 such as a display, speakers, a printer, etc. may also be included. The aforementioned devices are examples and others may be used.

Computing device 800 may also contain a communication connection 816 that may allow device 800 to communicate with other computing devices 818, such as over a network in a distributed computing environment, for example, an intranet or the Internet. Communication connection 816 is one example of communication media. Communication media may typically be embodied by computer readable instructions, data structures, program modules, or other data in a modulated data signal, such as a carrier wave or other transport mechanism, and includes any information delivery media. The term "modulated data signal" may describe a signal that has one or more characteristics set or changed in such a manner as to encode information in the signal. By way of example, and not limitation, communication media may include wired media such as a wired network or direct-wired connection, and wireless media such as acoustic, radio frequency (RF), infrared, and other wireless media. The term computer readable media as used herein may include both storage media and communication media.

As stated above, a number of program modules and data files may be stored in system memory 804, including operating system 805. While executing on processing unit 802, programming modules 806 (e.g., throw speed calculation application 820) may perform processes including, for example, one or more of the data acquisition, calculation, and transmission steps as described above. The aforementioned process is an example, and processing unit 802 may perform other processes. Other programming modules that may be used in accordance with embodiments of the present disclosure may include electronic mail and contacts applications, word processing applications, spreadsheet applications, database applications, slide presentation applications, drawing or computer-aided application programs, etc.

Generally, consistent with embodiments of the disclosure, program modules may include routines, programs, components, data structures, and other types of structures that may perform particular tasks or that may implement particular abstract data types. Moreover, embodiments of the disclosure may be practiced with other computer system configurations, including hand-held devices, multiprocessor systems, microprocessor-based or programmable consumer electronics, minicomputers, mainframe computers, and the like. Embodiments of the disclosure may also be practiced in distributed computing environments where tasks are performed by remote processing devices that are linked through a communications network. In a distributed computing environment, program modules may be located in both local and remote memory storage devices.

Furthermore, embodiments of the disclosure may be practiced in an electrical circuit comprising discrete electronic elements, packaged or integrated electronic chips containing logic gates, a circuit utilizing a microprocessor, or on a single chip containing electronic elements or microprocessors. Embodiments of the disclosure may also be practiced using other technologies capable of performing logical operations such as, for example, AND, OR, and NOT, including but not limited to mechanical, optical, fluidic, and quantum technologies. In addition, embodiments of the disclosure may be practiced within a general purpose computer or in any other circuits or systems.

Embodiments of the disclosure, for example, may be implemented as a computer process (method), a computing system, or as an article of manufacture, such as a computer program product or computer readable media. The computer program product may be a computer storage media readable by a computer system and encoding a computer program of instructions for executing a computer process. The computer program product may also be a propagated signal on a carrier readable by a computing system and encoding a computer program of instructions for executing a computer process. Accordingly, the present disclosure may be embodied in hardware and/or in software (including firmware, resident software, micro-code, etc.). In other words, embodiments of the present disclosure may take the form of a computer program product on a computer-usable or computer-readable storage medium having computer-usable or computer-readable program code embodied in the medium for use by or in connection with an instruction execution system. A computer-usable or computer-readable medium may be any medium that can contain, store, communicate, propagate, or transport the program for use by or in connection with the instruction execution system, apparatus, or device.

The computer-usable or computer-readable medium may be, for example but not limited to, an electronic, magnetic, optical, electromagnetic, infrared, or semiconductor system, apparatus, device, or propagation medium. More specific computer-readable medium examples (a non-exhaustive list), the computer-readable medium may include the following: an electrical connection having one or more wires, a portable computer diskette, a random access memory (RAM), a read-only memory (ROM), an erasable programmable read-only memory (EPROM or Flash memory), an optical fiber, and a portable compact disc read-only memory (CD-ROM). Note that the computer-usable or computer-readable medium could even be paper or another suitable medium upon which the program is printed, as the program can be electronically captured, via, for instance, optical scanning of the paper or other medium, then compiled, interpreted, or otherwise processed in a suitable manner, if necessary, and then stored in a computer memory.

Embodiments of the present disclosure, for example, are described above with reference to block diagrams and/or operational illustrations of methods, systems, and computer program products according to embodiments of the disclosure. The functions/acts noted in the blocks may occur out of the order as shown in any flowchart. For example, two blocks shown in succession may in fact be executed substantially concurrently or the blocks may sometimes be executed in the reverse order, depending upon the functionality/acts involved.

While certain embodiments of the disclosure have been described, other embodiments may exist. Furthermore, although embodiments of the present disclosure have been described as being associated with data stored in memory and other storage mediums, data can also be stored on or read from other types of computer-readable media, such as secondary storage devices, like hard disks, solid state storage (e.g., USB drive), or a CD-ROM, a carrier wave from the Internet, or other forms of RAM or ROM. Further, the disclosed methods' stages may be modified in any manner, including by reordering stages and/or inserting or deleting stages, without departing from the disclosure.

All rights including copyrights in the code included herein are vested in and the property of the Applicant. The Applicant retains and reserves all rights in the code included herein, and grants permission to reproduce the material only in connection with reproduction of the granted patent and for no other purpose.

V. Claims

While the specification includes examples, the disclosure's scope is indicated by the following claims. Furthermore, while the specification has been described in language specific to structural features and/or methodological acts, the claims are not limited to the features or acts described above. Rather, the specific features and acts described above are disclosed as example for embodiments of the disclosure.

The following is claimed:

1. A training system comprising:

a throwing sleeve having a closed impact end, an open end, and an internal passage formed there between, wherein the internal passage is designed to receive a ball;

a means for securing the open end of the sleeve around a user's wrist such that the user's hand is positioned within the internal passage;

marking strips positioned on designated positions on the throwing sleeve, said designated positions corresponding to the left, middle and right sides of the user's hand at ninety-degree angles, wherein the marking strips are left and right marking strips of differing colors attached to sides of the throwing sleeve and a middle marking strip positioned on a top of the throwing sleeve, wherein the left, right and middle colored marking strips provide visual feedback for the wrist and forearm angle locations to an observer;

a finger loop attached to an inside of the throwing sleeve under the middle marking strip, wherein the finger loop is used to line up one of the marking strip with a finger of the user's throwing hand; and an end material positioned at the closed impact end of the throwing sleeve, wherein said end material reinforces a strength of the closed impact end, and wherein the marking strips provide visual feedback to the user, the marking strips enable the user to align an arm throwing motion with the user's body in a proper kinetic sequence.

2. The training system of claim 1, further comprising:

a rigid screen positioned within the throwing sleeve forming a brace for preventing interference between the throwing sleeve and the ball.

3. The training system of claim 1, wherein the means for securing includes marking strips which align with the marking strips on the throwing sleeve.

4. The training system of claim 1, wherein the finger loop includes sensors embedded in the finger loop.

5. The training system of claim 1, wherein the end material is configured to provide audible feedback as the ball impacts the end material.

6. The training system of claim 1, wherein the throwing sleeve has at least one sensor attached to the throwing sleeve.

7. The training system of claim 6, further comprising: a computing device in communication with the at least one sensor, the computing device comprising a memory storage and a processing unit coupled with the memory storage, wherein the processing unit is operative to receive a signal from the at least one sensor.

8. A training system comprising:

a throwing sleeve having a closed impact end, an open end, and an internal passage formed there between, wherein the internal passage is designed to receive a ball, and wherein the throwing sleeve has at least one sensor attached to the throwing sleeve, the at least one sensor being configured to detect data associated with a motion of the ball within the internal passage;

a means for securing the open end of the sleeve around a user's wrist such that the user's hand is positioned within the internal passage;

marking strips positioned on designated positions on the throwing sleeve, said designated positions corresponding to the left, middle and right sides of the user's hand at ninety-degree angles, wherein the marking strips are left and right marking strips of differing colors attached to sides of the throwing sleeve and a middle marking strip positioned on a top of the throwing sleeve, wherein the left, right and middle colored marking strips provide visual feedback for the wrist and forearm angle locations to an observer;

a finger loop attached to an inside of the throwing sleeve under the middle marking strip;

an end material positioned at the closed impact end of the throwing sleeve, wherein said end material reinforces the strength of the closed impact end; and a computing device in communication with the at least one senor, the computing device comprising a memory storage and a processing unit coupled with the memory storage, wherein the processing unit is operative to receive a signal from the at least one sensor, and wherein the marking strips provide visual feedback to the user, the marking strips enable the user to align the arm throwing motion with the user's body in a proper kinetic sequence.

9. The training system of claim 8, further comprising:

a rigid screen positioned within the throwing sleeve forming a brace for preventing interference between the throwing sleeve and the ball.

10. The training system of claim 8, wherein the means for securing includes marking strips which align with the marking strips on the throwing sleeve.

11. The training system of claim 8, wherein the finger loop includes sensors embedded in the finger loop.

12. The training system of claim 8, wherein the end material is configured to provide audible feedback as the ball impacts the end material.

13. The training system of claim 8, wherein the finger loop is used to line up the middle marking strip with the middle finger of the user's throwing hand.

14. The training system of claim 8, wherein the at least one sensor is positioned within the end material.

15. A training system comprising:

a throwing sleeve having a closed impact end, an open end, and an internal passage formed there between, wherein the internal passage is designed to receive a ball, and wherein the throwing sleeve has at least one sensor attached to the throwing sleeve, the at least one sensor being configured to detect data associated with a motion of the ball within the internal passage;

a means for securing the open end of the sleeve around a user's wrist such that the user's hand is positioned within the internal passage;

a rigid screen positioned within the throwing sleeve forming a brace for preventing interference between the throwing sleeve and the ball;

marking strips positioned on designated positions on the throwing sleeve, said designated positions corresponding to the left, middle and right sides of the user's hand at ninety-degree angles, wherein the marking strips are left and right marking strips of differing colors attached to sides of the throwing sleeve and a middle marking strip positioned on a top of the throwing sleeve, wherein the left, right and middle colored marking strips provide visual feedback for the wrist and forearm angle locations to an observer;

a finger loop attached to an inside of the throwing sleeve under the middle marking strip, the finger loop being configured to align a figure of the user's hand with the middle marking strip;

an end material positioned at the closed impact end of the throwing sleeve, wherein said end material reinforces the strength of the closed impact end and is configured to provide audible feedback as the ball impacts the end material; and a computing device in communication with the at least one senor, the computing device comprising a memory storage and a processing unit coupled with the memory storage, wherein the processing unit is operative to receive a signal from the at least one sensor, and wherein the marking strips provide visual feedback to the user, the marking strips enable the user to align the arm throwing motion with the user's body in a proper kinetic sequence.

16. The training system of claim 8, wherein the means for securing includes marking strips which align with the marking strips on the throwing sleeve.

17. The training system of claim 8, wherein the finger loop includes sensors embedded in the finger loop.

18. The training system of claim 8, wherein the at least one sensor is attached within the end material.

19. The training system of claim 8, wherein the finger loop is further used to line up the middle marking strip with the middle finger of the user's throwing hand.

* * * * *